United States Patent [19]

Humphrey

[11] Patent Number: 5,001,802

[45] Date of Patent: Mar. 26, 1991

[54] FLEXIBLE HANDLE YARD BROOM

[76] Inventor: Laurence E. Humphrey, 89-A Cardinal Cir., Whispering Pines, N.C. 28327

[21] Appl. No.: 481,884

[22] Filed: Feb. 20, 1990

[51] Int. Cl.[5] ..... A46B 15/00

[52] U.S. Cl. ..... 15/159 R; 15/143 R; 15/229.6

[58] Field of Search ..... 15/143 R, 144 R, 159 R, 15/229.6, 16.7, 145; 56/400.01, 400.16, 400.17, 400.21, 400.04

[56] References Cited

U.S. PATENT DOCUMENTS

| | | | |
|---|---|---|---|
| 1,982,910 | 12/1934 | Forbes et al. | 15/143 R |
| 2,131,612 | 9/1938 | Campbell | 56/400.17 |
| 2,664,582 | 1/1954 | Kammann | 15/143 R |
| 4,003,668 | 1/1977 | Kelly, III et al. | 15/145 X |
| 4,137,693 | 2/1979 | Thompson et al. | 56/16.7 X |
| 4,244,168 | 1/1981 | Howard | 56/400.17 |
| 4,704,758 | 11/1987 | Hoffman | 15/144 |
| 4,741,149 | 5/1988 | vom Braucke et al. | 56/400.04 |
| 4,785,489 | 11/1988 | Von Doehren | 15/111 |
| 4,794,663 | 1/1989 | Vosbikian | 15/229.6 |

FOREIGN PATENT DOCUMENTS

| | | | |
|---|---|---|---|
| 862313 | 3/1961 | United Kingdom | 56/400.01 |

*Primary Examiner*—Frankie L. Stinson
*Attorney, Agent, or Firm*—Richard E. Jenkins

[57] ABSTRACT

A yard broom for sweeping leaves, pine needles and other debris from a yard having a base with a plurality of bristles anchored in the bottom thereof in at least one row of spaced-apart apertures. Flexible plastic handle means is secured to the base and adapted for flexing radially outwardly a sufficient distance during a sweeping motion of the broom to snappingly urge the base and bristles forwardly near the end of a sweeping motion to aid in clearing debris therefrom. The handle means comprises a plastic pipe which will radially flex at least 3 inches during a sweeping motion of the yard broom.

7 Claims, 2 Drawing Sheets

FLEXIBLE HANDLE YARD BROOM

DESCRIPTION

1. Technical Field

The present invention relates generally to the field of outdoor broom rakes for sweeping debris such as leaves and pine needles from a lawn, and more specifically to a flexible handle yard broom which is useful for sweeping leaves and other debris from a yard without the debris becoming entangled in the bristles of the broom.

2. Background Art

It has been well known in the past to use rakes as well as brooms to sweep debris such as leaves, pine needles, and the like from a lawn area for disposal. For example, a conventional garden rake can be used to remove leaves and pine needles, but due to its weight and the distance between tines, it is not a particularly effective implement to effectively do so. Bamboo rakes are also known and have been used to clean leaves and other debris from a yard area but this rake is also not efficient for this use since the bamboo tines are wide and the distance between tines is relatively great and thus the rake will not perform efficiently in sweeping yard debris, particularly pine needles. Another type of rake, the spring steel rake, is a relatively effective tool for removing yard debris such as leaves and pine needles from a lawn. However, it suffers from the disadvantages of its relatively great weight and its inability to remove isolated pieces of small debris such as pine needles that may be stuck in the lawn grass.

Also, Howard U.S. Pat. No. 4,244,168 discloses a broom-type rake for both sweeping and raking debris from the lawn. The broom comprises plastic bristles which are bent at an angle between about 100°–150° so as to facilitate a broom action when the implement is pushed away from the user and a rake action when the implement is pulled towards the user. As disclosed in Howard, the handle of the broom rake may be made of any suitable plastic, wood or other rigid material commonly used for handles.

Thus, the search for a more perfect implement for easily and efficiently removing debris such as leaves and the like from a lawn continues.

DISCLOSURE OF THE INVENTION

In accordance with the present invention, applicant provides an improved yard broom which is particularly effective in removing leaves and pine needles from a lawn. The yard broom comprises an elongated base having bristles anchored in at least a single row of spaced-apart apertures in the bottom of the base. A flexible plastic handle is attached to the base and adapted for flexing radially outwardly at least a distance of 3 inches during a sweeping motion of the broom and, when the bristles leave the ground, the energy stored in the bent handle releases to snappingly urge the base and bristles forwardly near the end of the sweeping motion so as to aid in clearing debris from the bristles.

It is therefore a principle object of the present invention to provide a yard broom which is lightweight and effectively removes leaves from a lawn.

A further object of the present invention is to provide a yard broom with a flexible handle which will radially deflect during the sweeping movement of the broom and then near the end of the sweeping motion, when the bristles leave the ground, the energy stored in the bent handle releases to snappingly urge the base and bristles forwardly so as to aid in clearing leaves, pine needles and the like from the bristles.

It is yet another object of the present invention to provide a yard broom which generates a snapping action of the bristle brush near the end of the sweeping stroke which effectively forces tree leaves forwardly thereof to make it easier to rapidly sweep a lawn area of leaves.

A further object of the present invention is to provide a yard broom which does not require continuous hand cleaning and removal of leaves from the bristle brush thereof during sweeping of yard debris from a lawn.

A still further object of the present invention is to provide a yard broom wherein if minor debris should accumulate in the bristles the debris can be readily removed by simply drawing the back of the broom toward the user at the conclusion of a sweeping motion.

BRIEF DESCRIPTION OF THE DRAWINGS

Some of the objects of the invention having been stated, other objects will become evident as the description proceeds, when taken in connection with the accompanying, in which.

BEST MODE FOR CARRYING OUT THE INVENTION

Figure 1:
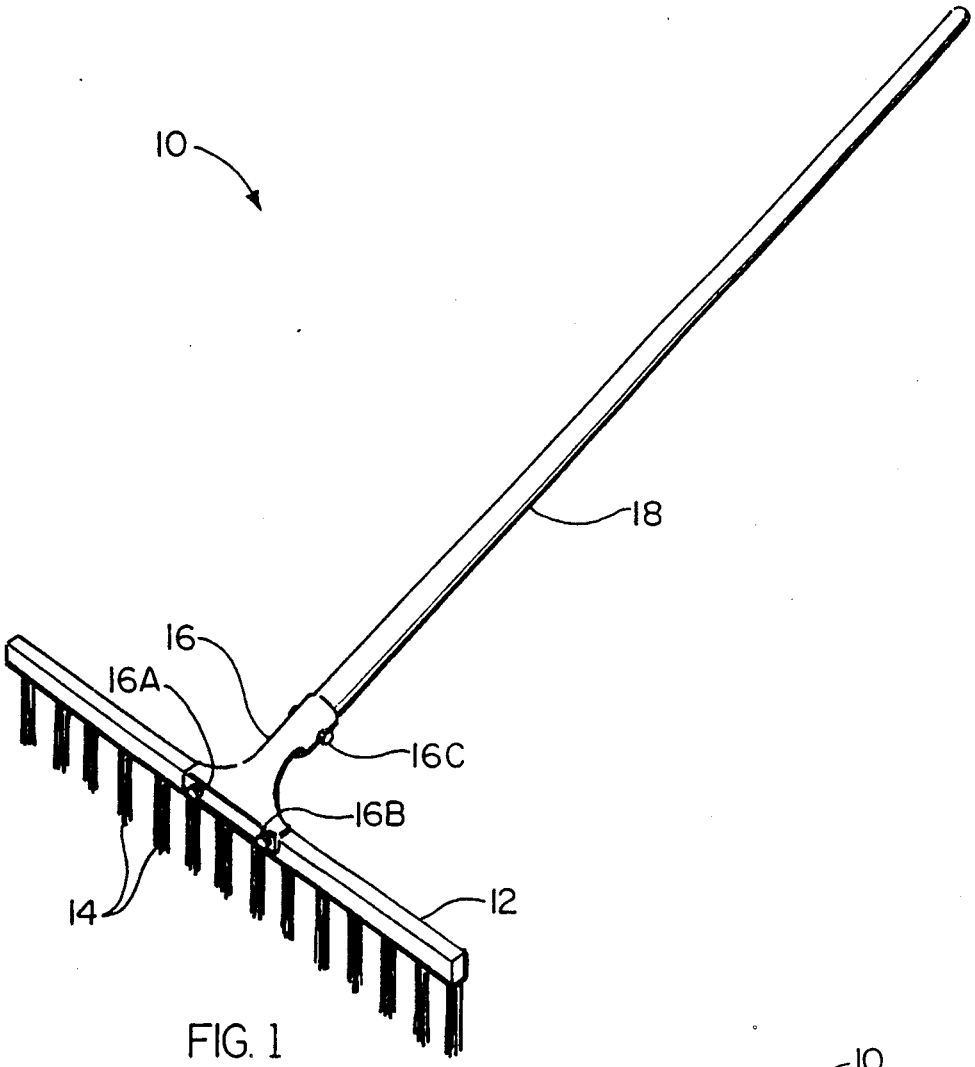
FIG. 1 is a perspective view of the yard broom of the invention.
Figure 2:
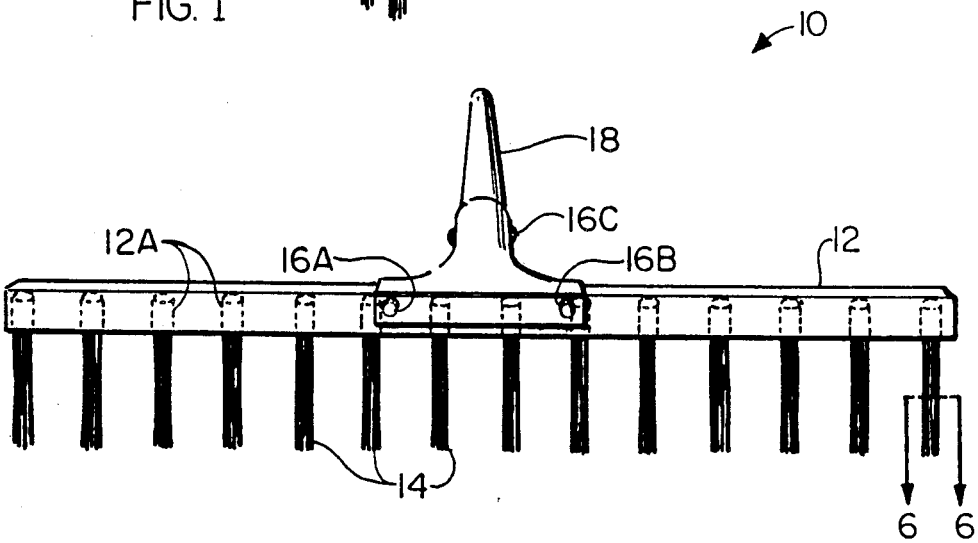
FIG. 2 is a front elevation view of the yard broom of the present invention.
Figure 3:
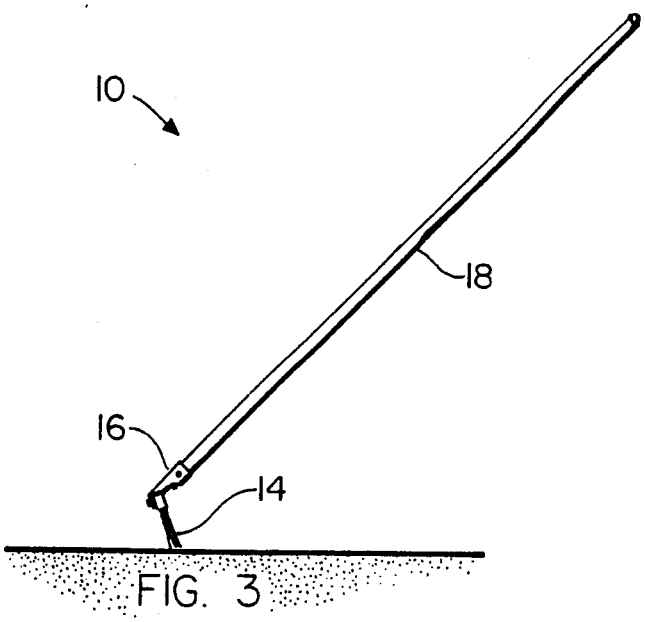
FIG. 3 is a side elevation view of the yard broom of the present invention.
Figure 4:
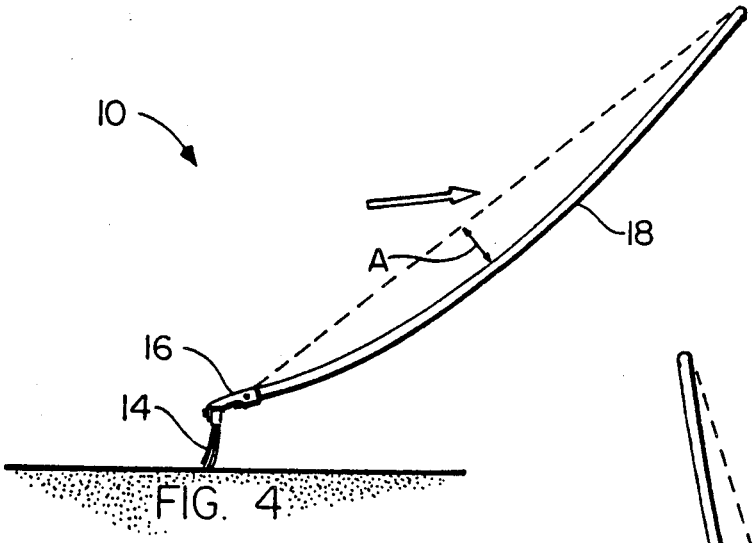
FIG. 4 is a side elevation view of the yard broom of the present invention during sweeping movement thereof.
Figure 5:
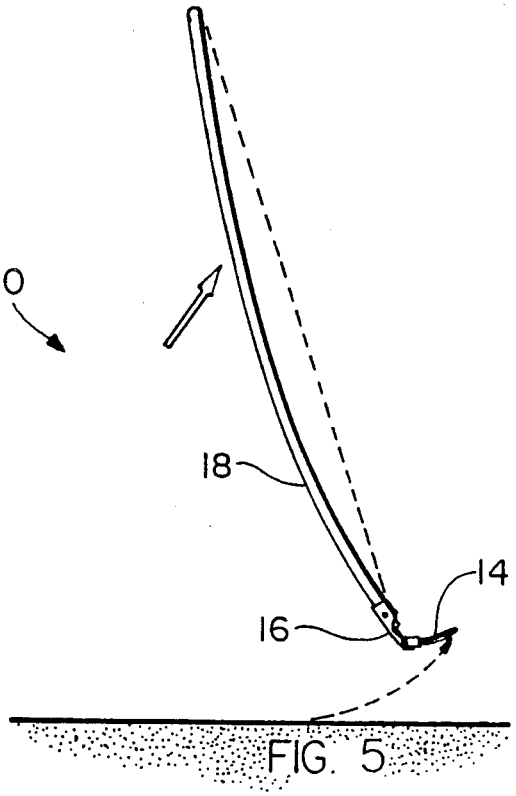
FIG. 5 is a side elevation view of the yard broom of the present invention at the end of a sweeping movement when the energy stored in the radially flexed handle is dissipated by a forward snapping movement of the bristle brush.
Figure 6:
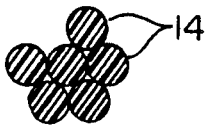
FIG. 6 is a cross sectional view taken along lines 6—6 of FIG. 2 showing a cross sectional view of a bristle bundle anchored in one of the spaced-apart apertures of the base of the yard broom.

As can be seen by reference to FIGS. 1–6 of the drawings, a yard broom which is a representative embodiment of the invention is generally designated by the reference numeral 10. Yard broom 10 is constructed of a base 12 which may be of any suitable material such as wood or plastic. A representative size of base 12 would be a length of 18 to 24 inches, a height of 1 to 2 inches and a width of about ½ to 1 inches, although other sizes are contemplated as within the scope of the invention. Base 12 includes a plurality of spaced-apart apertures 12A in the bottom thereof into each of which are secured a bundle of bristles 14. Most suitably, apertures 12A define a single row along the length of base 12 and are spaced apart about ½inch on centers, and bristles 14 secured therein have a preferred exposed length of about 3 inches and are plastic bristles having an annular cross section. Preferably, six (6) annular cross section bristles 14 are secured in each aperture 12A if broom 10 is to be used exclusively to remove pine needles, and ten (10) bristles of either annular or triangular cross section are secured in each aperture if broom 10 is to be used for general purposes.

Most suitably, connector 16 is a plated steel stamping which is attached to base 12 with bolts 16A and 16B (see FIG. 2) which are used in conjunction with conventional washers and nuts (not shown). The top end of connector 16 receives handle 18 therein and is secured thereto with bolt and nut assembly 16C.

Handle 18 is preferably a polyvinyl chloride (PVC) pipe which is capable of substantial lateral or radial flexing (as can best be seen in FIGS. 4–5) during sweeping movements of yard broom 10, although other handle materials could be utilized which provide the necessary resilient flexibility to handle 18. The substantial radial displacement of handle 18 stores a significant amount of energy which is released when bristles 14 leave the ground by a quick, snapping forward movement of base 12 and bristles 14 (see FIG. 5) near the end of the sweeping motion of yard broom 10. Very importantly, plastic pipe 18 must be selected so as to be capable of at least a 3 inch radial displacement A (see FIG. 4) during sweeping movement of yard broom 10 by a user.

Applicant has discovered that representative plastic pipes which will provide the necessary radial flexibility include a 5 foot length of ¾ inch internal diameter plastic pipe with a 200 p.s.i. rating as well as a 5 foot length of ½ inch internal diameter plastic pipe with a 315 p.s.i. rating. However, applicant contemplates that any type of highly resilient plastic piping or other piping which will provide for at least 3 inches of resilient radial displacement during the sweeping movement of yard broom 10 should be satisfactory for use as the handle of the instant invention. More specifically, applicant contemplates that any resiliently flexible handle constructed from a material which will allow for ½–2½ inches of deflection per pound of load on the end of a 30 inch length thereof will be satisfactory for the handle of the instant invention.

Also, applicant has found that in a preferred embodiment of the yard broom of the instant invention the angle defined between the longitudinal axis of plastic pipe 18 and the longitudinal axis of bristles 14 is between about 115°–135°. Specifically, it has been found that an angle of about 115°–125° is particularly effective for sweeping pine straw and an angle of about 125°–135° is particularly effective for sweeping leaves.

In operation, the yard broom is particularly efficient in raking leaves and pine needles from a lawn due to its flexible handle and light weight. The sweep by a user (typically from the user's left to right) causes the flexible handle to bend or radially flex downwardly. Near the end of the sweep, the bristles tend to disengage the yard surface so as to permit the bent handle to release and thereby snap the bristles and lower portion of the handle forward beyond their normal alignment (see FIG. 5) as the handle returns to its normal shape. This snapping action forces the yard debris on the bristles forwardly with almost no effort on the part of the user. The unique yard broom thus is able to sweep the leaves and related debris from a lawn more rapidly and with less effort than heretofore possible.

It will be understood that various details of the invention may be changed without departing from the scope of the invention. Furthermore, the foregoing description is for the purpose of illustration only, and not for the purpose of limitation—the invention being defined by the claims.

What is claimed is:

1. A broom device for sweeping leaves, pine needles and similar debris from a yard and comprising:

a. an elongated base at least 18 inches long and having a top and a bottom;

b. a plurality of plastic bristles anchored in said base and extending generally outwardly from the bottom of said base, said bristles being secured in at least one single row of spaced-apart apertures defined in the bottom of said base; and c. a flexible plastic handle secured to said base means for flexing radially outwardly a sufficient distance during a sweeping motion of said broom device to snappingly urge said base and bristles forwardly near the end of a sweeping motion so as to aid in clearing the debris therefrom, said plastic handle comprising a plastic pipe which will radially flex at least 3 inches during a sweeping motion of said broom device.

2. A broom device according to claim 1 wherein said bristles have an annular cross section.

3. A broom device according to claim 1 wherein said bristles have a triangular cross section.

4. A broom device according to claim 1 wherein said bristles are secured in apertures spaced-apart about ½ inch on centers in a single row along the length of said base and said bristles have an exposed length of about 3 inches.

5. A broom device according to claim 1 wherein said plastic handle comprises a 5 foot long plastic pipe having a ¾ inch internal diameter and a 200 p.s.i. rating.

6. A broom device according to claim 1 wherein said plastic handle comprises a 5 foot long plastic pipe having a ½ inch internal diameter and a 315 p.s.i. rating.

7. A broom device according to claim 1 wherein the angle defined between the longitudinal axis of said plastic pipe and the longitudinal axis of said bristles is between about 115°–135°.

* * * * *